US011224100B2

(12) United States Patent
Negretti et al.

(10) Patent No.: US 11,224,100 B2
(45) Date of Patent: Jan. 11, 2022

(54) HEATING ZONE WITH AN ILLUMINATION DEVICE FOR A COOKING HOB

(71) Applicant: ELECTROLUX APPLIANCES AKTIEBOLAG, Stockholm (SE)

(72) Inventors: Peter Negretti, Forli (IT); Gabriel Papp, Rothenburg ob der Tauber (DE); Jochen Holzinger, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 17/276,892

(22) PCT Filed: Sep. 20, 2019

(86) PCT No.: PCT/EP2019/075344
§ 371 (c)(1),
(2) Date: Mar. 17, 2021

(87) PCT Pub. No.: WO2020/058484
PCT Pub. Date: Mar. 26, 2020

(65) Prior Publication Data

US 2021/0251052 A1 Aug. 12, 2021

(30) Foreign Application Priority Data

Sep. 21, 2018 (EP) ..... 18195837

(51) Int. Cl.
*H05B 6/12* (2006.01)
*F24C 7/08* (2006.01)
*H05B 6/06* (2006.01)

(52) U.S. Cl.
CPC ..... *H05B 6/062* (2013.01); *H05B 6/1218* (2013.01); *H05B 2213/03* (2013.01)

(58) Field of Classification Search
CPC combination set(s) only.
See application file for complete search history.

(56) References Cited

U.S. PATENT DOCUMENTS 4,990,750 A * 2/1991 Martel ..... F24C 15/105 219/445.1
2003/0164370 A1* 9/2003 Aihara ..... H05B 6/1263 219/622

(Continued)

FOREIGN PATENT DOCUMENTS

| | | |
|---|---|---|
| EP | 2648478 | 10/2013 |
| EP | 3386271 | 10/2018 |
| JP | 2003133039 | 5/2003 |

OTHER PUBLICATIONS

International Search Report and Written Opinion for PCT/EP2019/075344 dated Dec. 13, 2019, 9 pages.

*Primary Examiner* — Michael A Laflame, Jr.
(74) *Attorney, Agent, or Firm* — Pearne & Gordon LLP

(57) ABSTRACT

An illumination device for a heating zone of a cooking hob. The illumination device comprises a light source element and a reflecting element. Further, the illumination device comprises an insulating layer horizontally arranged within the heating zone. Said insulating layer includes a light channel formed as a cut-out. The illumination device comprises a reflecting, diffusing and/or refracting layer covering at least the light channel. The light source element and the reflecting element are arranged such that a light beam from said light source element is redirected by the reflecting element into the light channel.

21 Claims, 6 Drawing Sheets

(56) References Cited

U.S. PATENT DOCUMENTS

Figure 2:
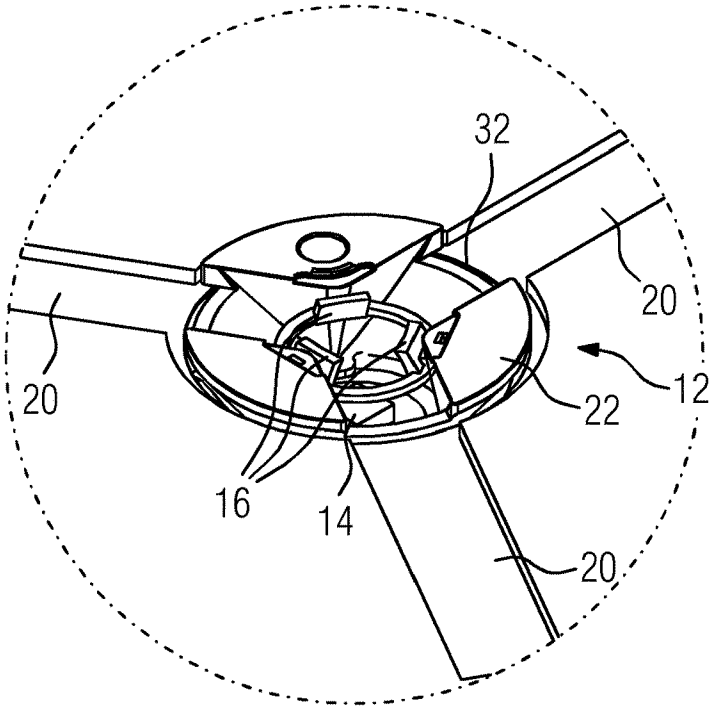

| | | | | |
|---|---|---|---|---|
| 2003/0183617 | A1* | 10/2003 | Platt | H05B 3/68<br>219/452.11 |
| 2013/0032133 | A1* | 2/2013 | Tisselli | F24C 15/105<br>126/213 |
| 2015/0300650 | A1* | 10/2015 | Negretti | F24C 15/10<br>99/337 |
| 2019/0246788 | A1* | 8/2019 | Demol | F24C 7/082 |

* cited by examiner

HEATING ZONE WITH AN ILLUMINATION DEVICE FOR A COOKING HOB

The present invention relates to a heating zone for a cooking hob, in particular for an induction cooking hob, according to the preamble of claim 1. Moreover, the present invention relates to a cooking hob, in particular an induction cooking hob.

The illumination of a heating zone on a cooking hob is usually performed by light source elements arranged beside or between the heating elements. For example, the light source element is arranged in the centre of an induction coil, so that the centre of the heating zone is illuminated. However, an illumination of the heating zone itself is not possible.

EP 2 648 478 A1 discloses an illumination device for a cooking zone element. Said cooking zone element is provided for a cooking hob covered by a transparent panel. The cooking zone element comprises a central cut-out arranged in a central portion of the cooking zone element. The illumination device is arranged in the central cut-out of the cooking zone element. A light source element is arranged beneath the central cut-out. An optical lens encloses the upper portion of said light source element. A conical light guide formed as conical tube is arranged inside the central cut-out and above the optical lens. However, this illumination device illuminates only the central portion of the cooking zone element.

It is an object of the present invention to provide a heating zone for a cooking hob, which allows an improved illumination of said heating zone.

The object of the present invention is achieved by heating zone according to claim 1.

According to the present invention a heating zone of a cooking hob, in particular of an induction cooking hob, is provided, wherein:

- the heating zone comprises an illumination device,
- the illumination device comprises at least one light source element,
- the illumination device comprises at least one reflecting element,
- the illumination device comprises at least one insulating layer horizontally arranged within the heating zone,
- said insulating layer includes at least one light channel formed as a cut-out,
- the illumination device comprises at least one reflecting, diffusing and/or refracting layer,
- the reflecting, diffusing and/or refracting layer covers at least the light channel, and
- the light source element and the reflecting element are arranged that a light beam from said light source element is redirected by the reflecting element into the light channel.

The core of the present invention is the combination of the light source element, the reflecting element and the light channel formed as a cut-out in the insulating layer. The side walls of the light channel are formed by the insulating layer, while the top side of the light channel is formed by the reflecting, diffusing and/or refracting layer. This structure allows an improved illumination of the heating zone.

Preferably, the light channel is elongated. This allows a large illuminated area.

In particular, the reflecting, diffusing and/or refracting layer is made of mica. The mica layer allows an even distribution of the light intensity.

Further, the insulating layer may be made of glass fibre.

Preferably, the thickness of the insulating layer is at least 0.5 mm, more preferably at least 1.0 mm, most preferably at least 1.5 mm. A higher thickness of said insulation layer advantageously increases stability and dampening to the light channels.

Preferably, the thickness of the insulating layer is at maximum 3.0 mm, more preferably at maximum 2.5 mm, most preferably at maximum 2.25 mm. A lower thickness of said insulation layer is advantageous in reduced space requirements. Thus, said lower thickness of the insulation layer reduces the entire build-in height of the heating elements and/or the cooking hob.

The present inventors have found that the thickness of the insulating layer is preferably within the range from at least 0.5 mm and at most 3.0 mm, more preferably from at least 0.5 mm to at most 2.5 mm, from at least 0.5 mm to at most 2.25 mm, from at least 1.0 mm to at most 3.0 mm, from at least 1.0 mm to at most 2.5 mm, from at least 1.0 mm to at most 2.25 mm, still more preferably in the range from at least 1.5 mm to at most 3.0 mm, in the range from at least 1.5 mm to at most 2.5 mm, and in the range from at least 1.5 mm to at most 2.25 mm.

Additionally, the illumination device may comprise at least one further reflecting, diffusing and/or refracting layer arranged beneath the insulating layer and arrangeable or arranged above the heating zone, wherein said further reflecting, diffusing and/or refracting layer forms a bottom of the light channel, and wherein preferably the further reflecting, diffusing and/or refracting layer is made of mica. Thus, also the bottom of the light channel is formed by the reflecting, diffusing and/or refracting layer.

Preferably, the reflecting, diffusing and/or refracting layer and/or the further reflecting, diffusing and/or refracting layer are coloured or painted white.

Furthermore, the reflecting, diffusing and/or refracting layer and/or the further reflecting, diffusing and/or refracting layer may have a thickness less than 1 mm, preferably between 0.1 mm and 0.5 mm.

In particular, at least one reflecting element is a beam splitter, wherein said beam splitter includes a plurality of mirror elements, and wherein preferably the beam splitter is made of plastics, glass, borosilicate or metal, e.g. aluminium or steel.

According to a preferred embodiment of the present invention the light source element and the reflecting elements are arrangeable or arranged in the centre of the heating zone, while a plurality of light channels extend radially, wherein preferably said reflecting elements are arrangeable or arranged opposite to the light channels.

Further, at least one reflecting element may be a prism, wherein preferably said prism includes a concave surface section.

Further, at least one support element may have a reflective supporting geometry.

Additionally, the illumination device may comprise at least one support device for supporting the at least one light source element and the at least one reflecting element.

Moreover, the illumination device may comprise at least one light mask arrangeable or arranged above the reflecting, diffusing and/or refracting layer.

The illumination device may comprise a plurality of light source elements, wherein preferably said light source elements are separated by light screen elements.

At last, the present invention relates to a cooking hob, in particular an induction cooking hob, wherein said cooking hob comprises at least one heating zone cited above.

Novel and inventive features of the present invention are set forth in the appended claims.

Figure 1:
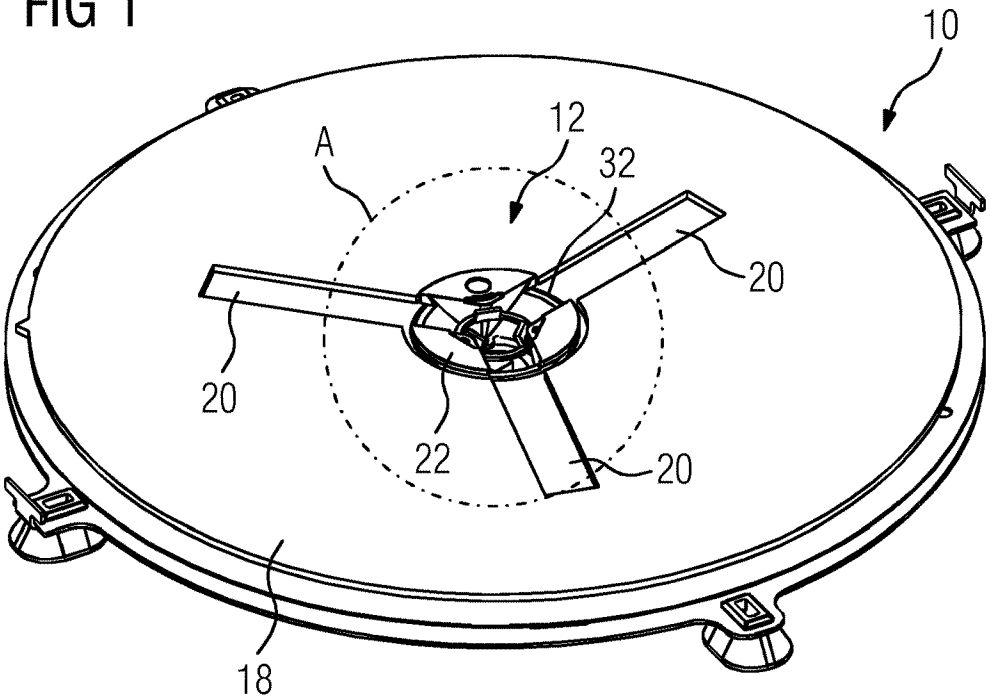
Figure 3:
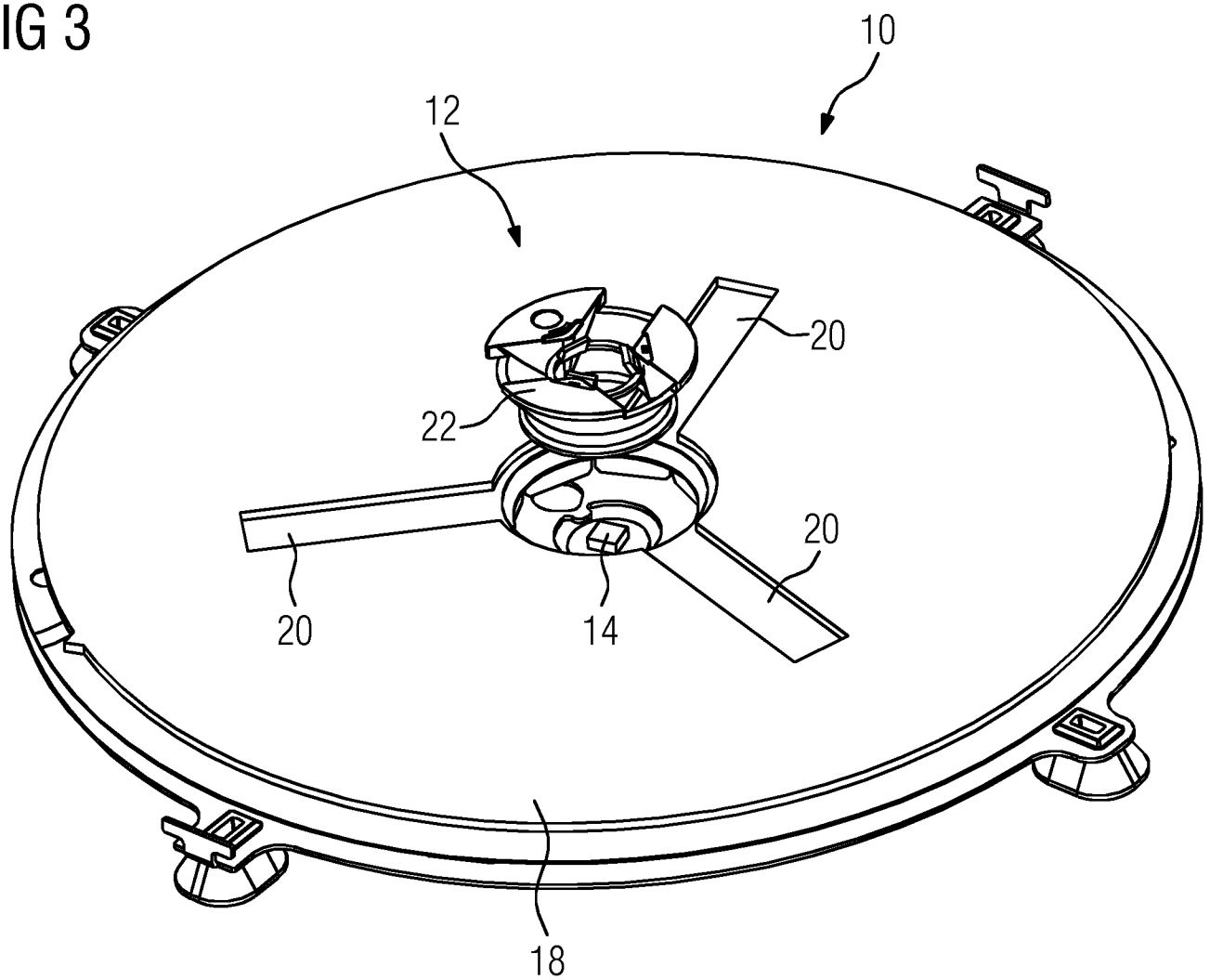
Figure 4:
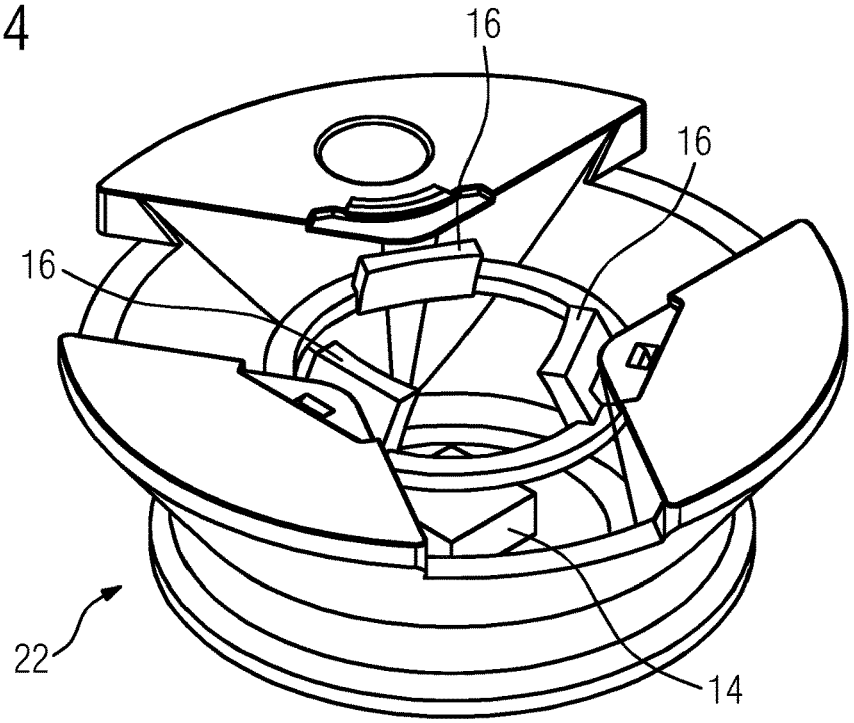
Figure 5:
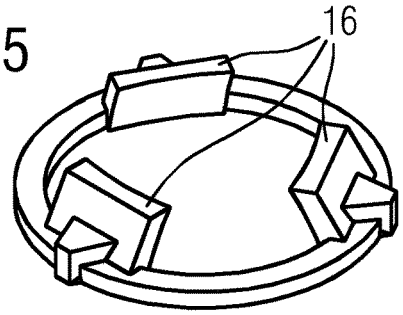
Figure 5:
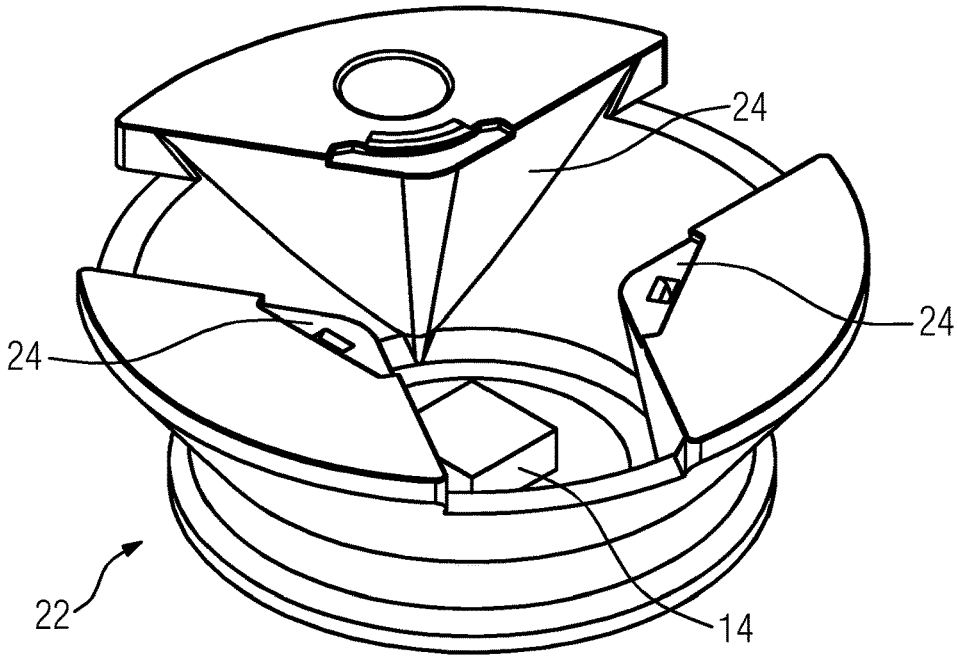
Figure 6:
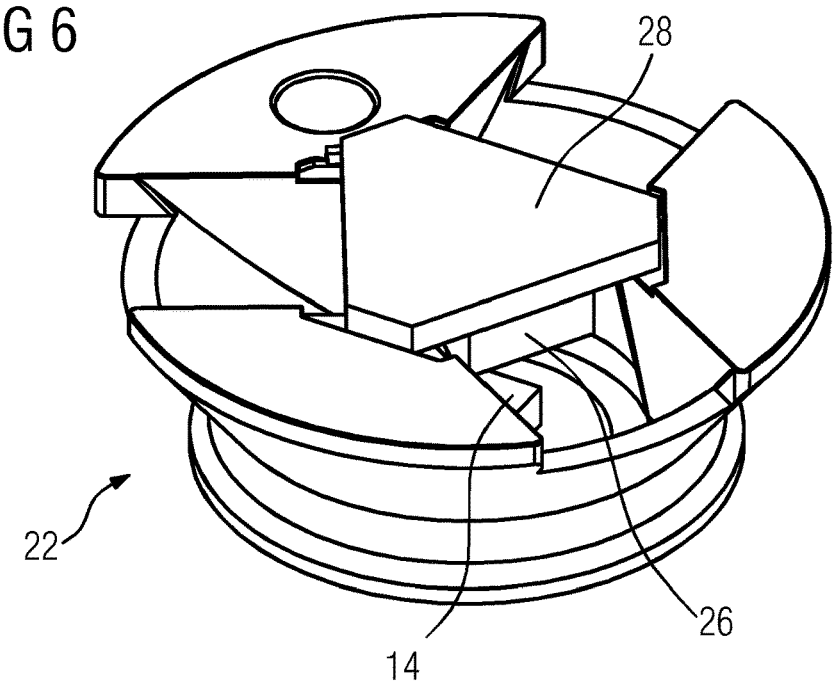
Figure 7:
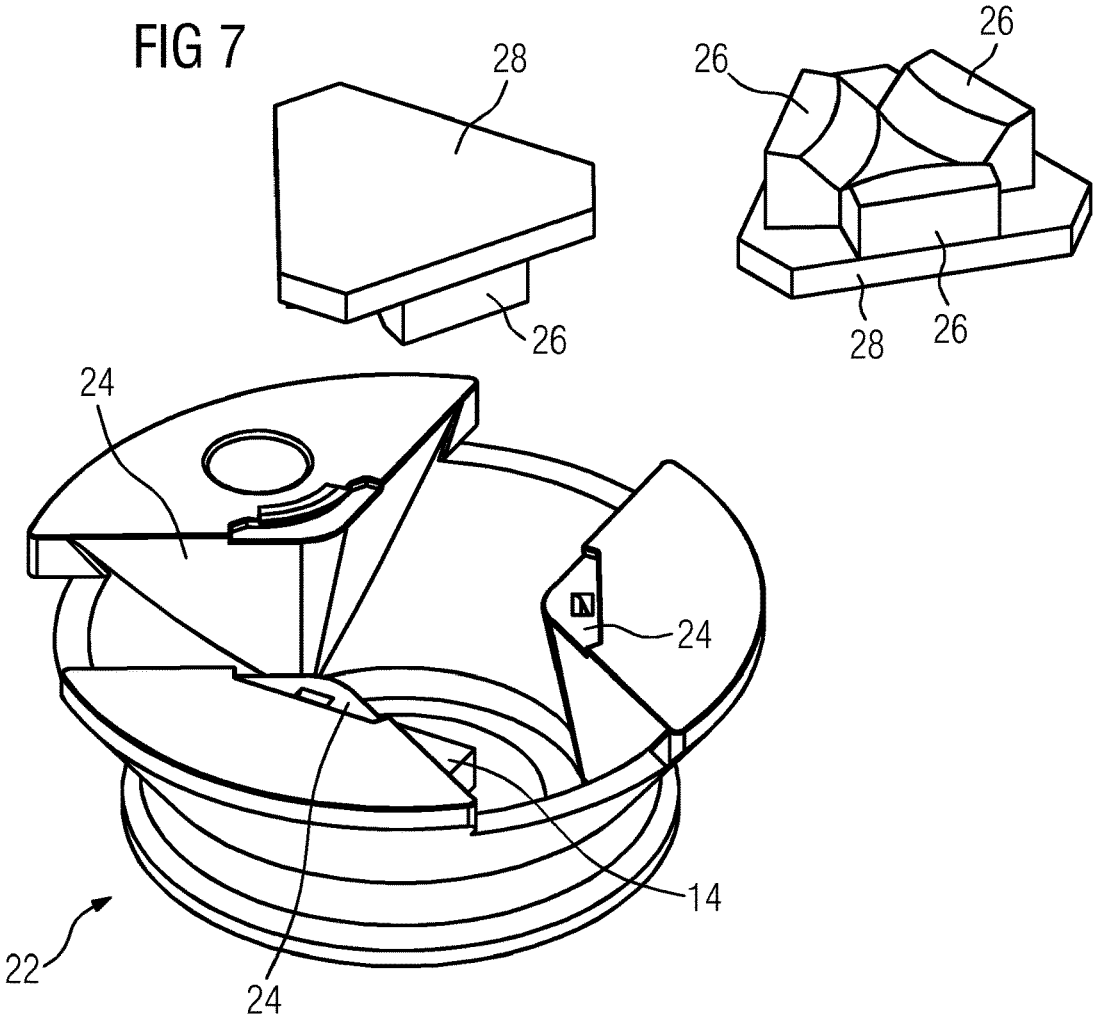
Figure 8:
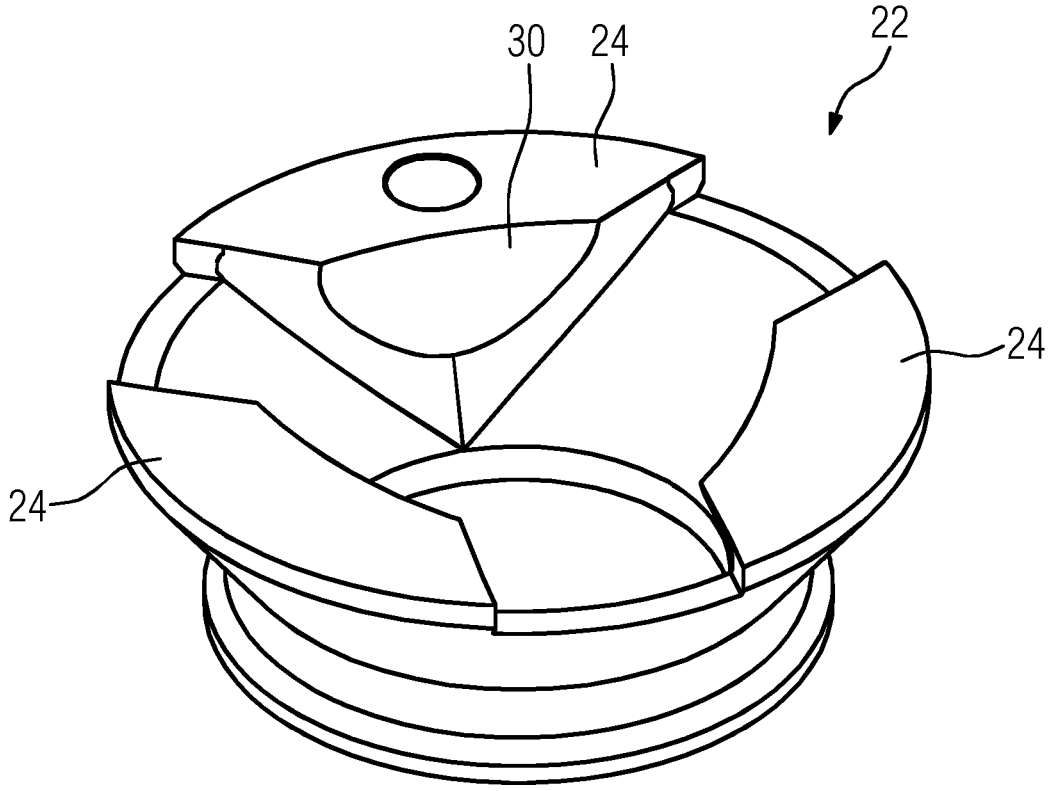
Figure 9:
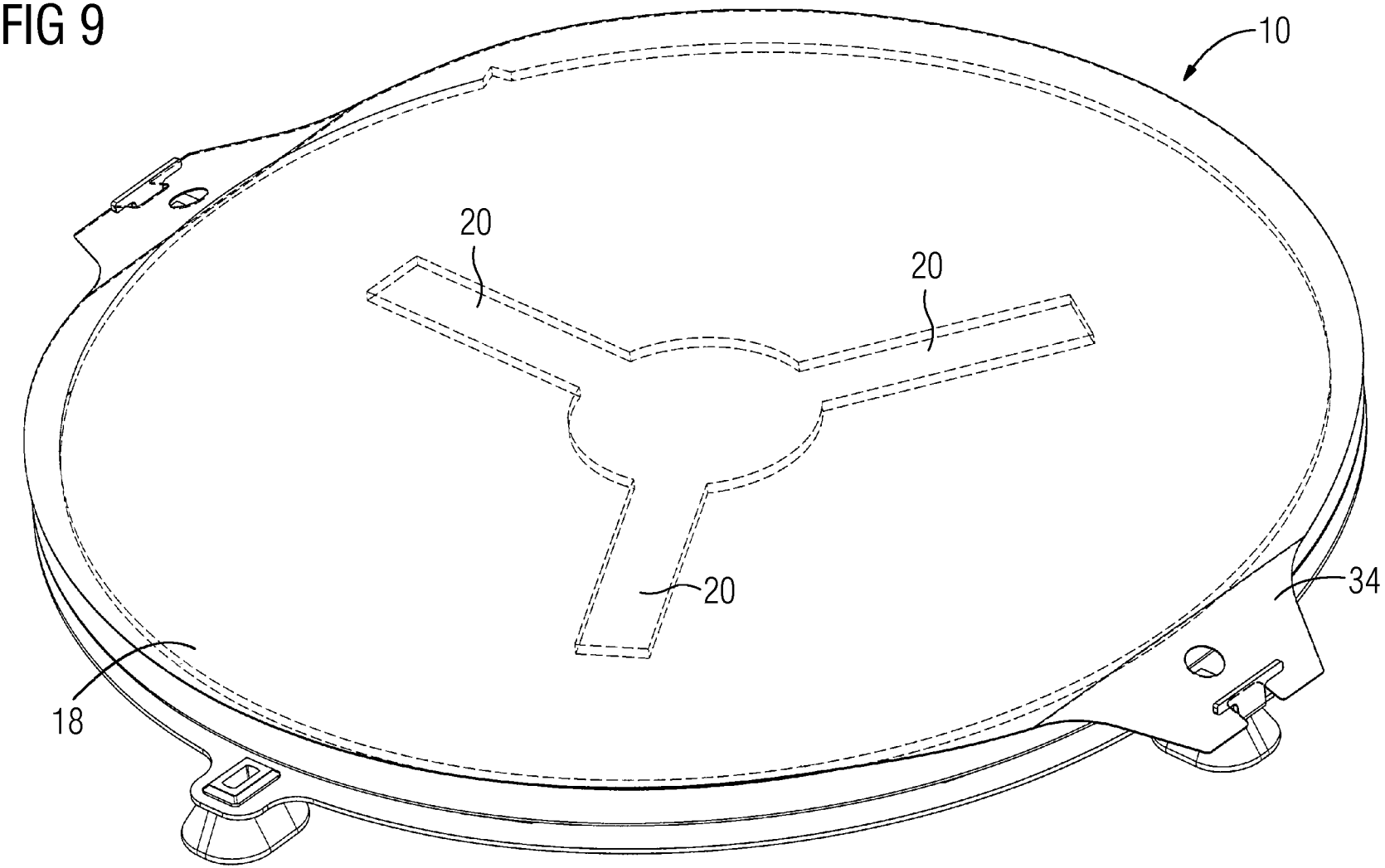

The present invention will be described in further detail with reference to the drawings, in which FIG. 1 illustrates a schematic perspective view of a heating zone with an illumination device according to a first embodiment of the present invention, FIG. 2 illustrates a schematic detailed perspective view of the illumination device on the heating zone according to the first embodiment of the present invention, FIG. 3 illustrates a schematic perspective view of the heating zone with the illumination device according to the first embodiment of the present invention, FIG. 4 illustrates a schematic perspective view of a support device for the illumination device according to the first embodiment of the present invention, FIG. 5 illustrates a schematic perspective view of the support device for the illumination device according to the first embodiment of the present invention, FIG. 6 illustrates a schematic perspective view of the support device for the illumination device according to a second embodiment of the present invention, FIG. 7 illustrates a schematic perspective view of the support device for the illumination device according to the second embodiment of the present invention, FIG. 8 illustrates a schematic perspective view of the support device for the illumination device according to a third embodiment of the present invention, and FIG. 9 illustrates a schematic perspective view of a heating zone with an illumination device, which is covered with a reflecting, diffusing and/or refracting layer.

FIG. 1 illustrates a schematic perspective view of a heating zone 10 with an illumination device 12 according to a first embodiment of the present invention. In this example, the heating zone is an induction coil of an induction cooking hob. However, the illumination device 12 according to the present invention may be applied to other heating zones.

The illumination device 12 comprises a support device 22. Said support device 22 is arranged in the centre of the heating zone 10. One light source element 14 and three reflecting elements 16 are attached at said support device 22. The heating zone 10 is covered by an insulating layer 18. In this example, the insulating layer 18 is a circular disk. Three light channels 20 are formed as cut-outs in said insulating layer 18. In general, an arbitrary number of light channels 20 may be formed as cut-outs in the insulating layer 18. The light channels 20 extend into radial directions. A further cut-out is formed in the centre of the insulating layer 18 and above the support device 22 for the light source element 14 and the reflecting elements 16. Preferably, the insulating layer 18 is made of glass fibres. In this example, the insulating layer 18 has a thickness of 2.0 mm. In general, the thickness of the insulating layer is within the range between 0.5 mm and 3.0 mm.

In this example, the light source element 14 and the reflecting elements 16 are arranged in the centre of the heating zone 12 or induction coil, respectively. In general, the light source element 14 and the reflecting elements 16 are arranged in a relative cold area of the heating zone 12, e.g. beside or close to said heating zone 12. Moreover, the light source element 14 and the reflecting elements 16 may be arranged in an area, which is cooled down, e.g. in a cooling channel.

An upper reflecting, diffusing and/or refracting layer 34 is arranged above the insulating layer 18 as illustrated in FIG. 9. The dashed lines shown in FIG. 9 illustrate the insulating layer 18 and the light channels 20 formed as cut-outs in the insulating layer 18, which are arranged beneath the upper reflecting, diffusing and/or refracting layer 34. Said reflecting, diffusing and/or refracting layer 34 covers the heating zone 10. The top side of the light channels 20 are closed by the reflecting, diffusing and/or refracting layer 34. The upper reflecting, diffusing and/or refracting layer 34 may be formed as a circular disk.

Preferably, the upper reflecting, diffusing and/or refracting layer 34 is made of mica. In particular, said mica layer is white coloured or painted. The layer made of mica is suitable for reflecting, diffusing and refracting light as well. The thickness of the reflecting, diffusing and/or refracting layer 34 is less than 1 mm, preferably between 0.1 mm and 0.5 mm.

Further, a lower reflecting, diffusing and/or refracting layer 32 is arranged beneath the insulating layer 18. Preferably, the lower reflecting, diffusing and/or refracting layer 32 is also made of mica. In particular, said mica layer is also white coloured or painted. For example, said lower reflecting, diffusing and/or refracting layer 32 is directly glued on the induction coil. Preferably, the lower reflecting, diffusing and/or refracting layer 32 may be formed as a circular disk.

FIG. 2 illustrates a schematic detailed perspective view of the illumination device 12 on the heating zone 10 according to the first embodiment of the present invention.

The support device 22 is arranged in the centre of the heating zone 10. The support device 22 includes a cylindrical circumferential wall. In this example, the bottom side and the top side of the support device 22 are substantially open. The light source element 14 is arranged in the centre of the heating zone and beneath the support device 22. Preferably, the light source element 14 is a light emitting diode (LED).

The reflecting elements 16 are arranged inside the cylindrical circumferential wall of the support device 22 and attached at a ring. In turn, said ring is attachable or attached at the support device 22. The three reflecting elements 16 are spaced equally from each other. The reflecting surfaces of the reflecting elements are directed inwardly. Each reflecting element 16 is arranged opposite to a corresponding light channel 20. For example, the reflecting elements 16 are made of glass, borosilicate, plastics or metal. Further, the reflecting elements 16 may be coated by a metal layer.

A light beam from the light source element 14 is reflected by the reflecting elements 16 and redirected into the opposite light channels 20. The reflecting, diffusing and/or refracting layer 34 above said light channels 20 reflects and refract said light beam, so that an area above the heating zone 10 is illuminated.

Further, the reflecting element 16 may be a beam splitter including several reflecting surfaces, i.e. mirrors. For example, the beam splitter includes three mirrors. The beam splitter may be directly arranged above the light source element 14. The beam splitter may be made of glass, borosilicate, plastic or metal, e.g. aluminium or steel. For example, the beam splitter made of plastic or metal has a circular shape with a hole in its centre, wherein the light is reflected by the plastic or metal. The beam splitter may be coated by a reflective material, e.g. chrome. The beam splitter allows internal total reflections. The beam splitter may be positioned in an area, where no influence of the electromagnetic field of the induction coil occurs.

FIG. 3 illustrates a schematic perspective view of the heating zone 10 with the illumination device 12 according to the first embodiment of the present invention. For clarity, the support device 22 with the three reflecting elements 16 is removed from its position in the centre of the heating zone 10. The light source element 14 is arranged in the centre of the heating zone and beneath the support device 22.

FIG. 4 illustrates a schematic perspective view of the support device 22 for the illumination device 12 according to the first embodiment of the present invention.

The support device 22 includes the cylindrical circumferential wall. In this example, the top side of the support device 22 is substantially open, while the bottom side of the support device 22 is partially or completely closed. The light source element 14 is arranged on the bottom of the support device 22. In this example, the light source element 14 is a light emitting diode (LED). The reflecting elements 16 are attached at a ring. In turn, said ring is clamped within the support device 22.

Further, three support elements 24 are arranged within the circumferential wall of the support device 22. Each support element 24 corresponds with one reflecting element 16. Said support elements 24 are arranged outside of the reflecting elements 16. The reflecting elements 16 act as beam splitter and effectively as reflecting devices. The support elements 24 support the reflecting elements 16 in redirecting the light beam from the light source element 14 into the light channels 20.

FIG. 5 illustrates a schematic perspective view of the support device 22 for the illumination device 12 according to the first embodiment of the present invention. In FIG. 5, the ring with the three reflecting elements 16 is removed from the support device 22 for purpose of clarity. The support elements 24 are arranged within the circumferential wall of the support device 22 and equally spaced from each other.

FIG. 6 illustrates a schematic perspective view of the support device 22 for the illumination device 12 according to a second embodiment of the present invention.

The support device 22 includes the cylindrical circumferential wall. In this example, the top side of the support device 22 is substantially open, while the bottom side of the support device 22 is partially or completely closed. The light source element 14 is arranged on the bottom of the support device 22. Preferably, the light source element 14 is a light emitting diode (LED).

Instead of the three reflecting elements 16, three prism elements 26 are attached at a support plate 28 in the second embodiment. In turn, the support plate 28 is attached within the support device 22. The prism elements 26 are attached at the bottom side of the support plate 28.

FIG. 7 illustrates a schematic perspective view of the support device 22 for the illumination device 12 according to the second embodiment of the present invention. For clarity, the support plate 28 with the three prism elements 26 is removed from the support device 22. Moreover, the upper and lower sides of the support plate 28 with the three prism elements 26 are shown in FIG. 7. The prism elements 26 act as beam splitters and reflecting elements.

FIG. 8 illustrates a schematic perspective view of the support device 22 for the illumination device 12 according to a third embodiment of the present invention.

Three support elements 24 are arranged within the circumferential wall of the support device 22. Each support element 24 includes a concave surface section 30. The support elements 24 act as beam splitter and effectively as reflecting devices. The support elements 24 support the reflections in order to redirect the light beam from the light source element 14 into the light channels 20.

Optionally, a light mask may be arranged above the upper reflecting, diffusing and/or refracting layer 34. Said light mask allows a specific light filtering.

The illumination device 12 according to the present invention allows an improved illumination of the heating zone 12. Said illumination device 12 may be realised by simple manufacturing and low complexity. The inventive illumination device 12 does not increase the thickness of the heating zone 12.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 heating zone
12 illumination device
14 light source element
16 reflecting element
18 insulating layer
20 light channel
22 support device
24 support element
26 prism element
28 support plate
30 concave surface section
32 lower reflecting, diffusing and/or refracting layer
34 upper reflecting, diffusing and/or refracting layer

The invention claimed is:

1. A heating zone for a cooking hob, wherein:
the heating zone comprises an illumination device,
the illumination device comprises a light source element,
the illumination device comprises a reflecting element,
the illumination device comprises a reflecting, diffusing and/or refracting layer,
the illumination device comprises an insulating layer horizontally arranged within the heating zone,
said insulating layer includes a light channel formed as a cut-out,
the reflecting, diffusing and/or refracting layer covers at least the light channel, and
the light source element and the reflecting element are arranged such that a light beam from said light source element is redirected by the reflecting element into the light channel.

2. The heating zone according to claim 1, wherein the light channel is elongated.

3. The heating zone according to claim 1, wherein the reflecting, diffusing and/or refracting layer is made of mica.

4. The heating zone according to claim 1, wherein the reflecting, diffusing and/or refracting layer is arranged above the insulating layer.

5. The heating zone according to claim 1, wherein the insulating layer is made of glass fibre.

6. The heating zone according to claim 1, wherein the illumination device comprises a further reflecting, diffusing and/or refracting layer arranged beneath the insulating layer and arranged above the heating zone, wherein said further reflecting, diffusing and/or refracting layer forms a bottom of the light channel.

7. The heating zone according to claim 6, wherein the reflecting, diffusing and/or refracting layer and the further reflecting, diffusing and/or refracting layer are coloured or painted white.

8. The heating zone according to claim 6, wherein the reflecting, diffusing and/or refracting layer and the further reflecting, diffusing and/or refracting layer have a thickness less than 1 mm.

9. The heating zone according to claim 1, wherein said reflecting element is a beam splitter that includes a plurality of mirror elements.

10. The heating zone according to claim 1, wherein the light source element and the reflecting element are arranged in a centre of the heating zone, while a plurality of said light channels extend radially.

11. The heating zone according to claim 1, wherein the reflecting element is a prism.

12. The heating zone according to claim 1, wherein the illumination device comprises a support device for supporting the light source element and the reflecting element.

13. The heating zone according to claim 1, wherein the illumination device comprises at least one a light mask arranged above the reflecting, diffusing and/or refracting layer.

14. The heating zone according to claim 1, wherein the illumination device comprises a plurality of said light source elements.

15. An induction cooking hob comprising the heating zone according to claim 1.

16. The heating zone according to claim 6, wherein the further reflecting, diffusing and/or refracting layer is made of mica.

17. The heating zone according to claim 8, wherein the reflecting, diffusing and/or refracting layer and the further reflecting, diffusing and/or refracting layer have a thickness between 0.1 mm and 0.5 mm.

18. The heating zone according to claim 9, wherein the beam splitter is made of plastics, glass, borosilicate or metal.

19. The heating zone according to claim 10, comprising a plurality of said reflecting elements arrangeable or arranged opposite to the light channels.

20. The heating zone according to claim 11, wherein said prism includes a concave surface section.

21. The heating zone according to claim 14, wherein said light source elements are separated by light screen elements.

* * * * *